US006296535B1

(12) United States Patent
Bland et al.

(10) Patent No.: US 6,296,535 B1
(45) Date of Patent: Oct. 2, 2001

(54) TILT-TRIM SUBSYSTEM FOR BOATS USING A STERN DRIVE SYSTEM

(75) Inventors: Gerald Francis Bland, Glenview; Stephen R. Johnson, Waukegan, both of IL (US); Gerald F. Neisen, Rockport, TX (US); Dan E. Nelson, Wildwood, IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/468,569

(22) Filed: Dec. 21, 1999

(51) Int. Cl.[7] ..... B63H 20/08
(52) U.S. Cl. ..... 440/61
(58) Field of Search ..... 440/53, 57, 61

(56) References Cited

U.S. PATENT DOCUMENTS

| | | | | |
|---|---|---|---|---|
| 3,581,702 | | 6/1971 | Moberg . | |
| 3,933,116 | * | 1/1976 | Adams et al. | 440/57 |
| 3,957,011 | * | 5/1976 | Hurst | 440/57 |
| 4,295,833 | | 10/1981 | Borst . | |
| 4,308,018 | | 12/1981 | Nakamura et al. . | |
| 4,373,920 | | 2/1983 | Hall et al. . | |
| 4,786,263 | | 11/1988 | Burmeister et al. . | |
| 4,925,411 | | 5/1990 | Burmeister et al. . | |
| 4,959,033 | * | 9/1990 | Bland et al. | 440/76 |
| 4,976,639 | | 12/1990 | Rawlings et al. . | |
| 5,030,148 | | 7/1991 | Funami et al. . | |
| 5,032,094 | | 7/1991 | Katogi . | |
| 5,041,033 | | 8/1991 | Funami . | |
| 5,118,315 | | 6/1992 | Funami et al. . | |
| 5,137,480 | | 8/1992 | Binversie et al. . | |
| 5,149,285 | | 9/1992 | Kinoshita . | |
| 5,156,561 | | 10/1992 | Kinoshita . | |
| 5,358,435 | * | 10/1994 | Rodskier | 440/61 |
| 5,372,528 | | 12/1994 | Nakamura et al. . | |
| 5,389,018 | | 2/1995 | Funami . | |
| 5,427,556 | | 6/1995 | Ishikawa et al. . | |
| 5,658,627 | | 8/1997 | Fujimaki et al. . | |
| 5,720,637 | | 2/1998 | Nakamura . | |
| 5,802,953 | | 9/1998 | Nakamura . | |
| 5,876,259 | | 3/1999 | Nakamura . | |
| 5,882,235 | | 3/1999 | Nakamura . | |
| 5,975,968 | * | 11/1999 | Nakamura | 440/61 |

* cited by examiner

*Primary Examiner*—S. Joseph Morano
*Assistant Examiner*—Andrew Wright
(74) *Attorney, Agent, or Firm*—Cook & Franke SC; Timothy J. Ziolkowski

(57) ABSTRACT

A tilt-trim subsystem assembly affixed to an outdrive of a stern drive that may be supported by a gimbal unit and may be configured to rotate about a predetermined axis to impart a desired trim or tilt to the drive system is provided. The tilt-trim assembly has one respective end thereof configured to pivotally receive one anchor pin supported by the outdrive. The assembly includes one or more cylinders having one end thereof pivotally connected to another anchor pin so that when the cylinder is actuated the outdrive and the tilt-trim subsystem assembly are a jointly rotated about the predetermined axis.

64 Claims, 5 Drawing Sheets

TILT-TRIM SUBSYSTEM FOR BOATS USING A STERN DRIVE SYSTEM

BACKGROUND OF THE INVENTION

The present invention is generally related to a tilt-trim subsystem assembly for marine propulsion devices, and, more particularly, to a tilt-trim subsystem assembly for a stern drive propulsion system.

In marine propulsion devices, it is common to have hydraulic cylinder/piston assemblies located externally of the boat for effecting pivotal movement of the propulsion unit relative to its a mounting bracket. For example, in marine propulsion devices of the aid stern drive or inboard/outboard type, it is common to have hydraulic cylinder/piston assemblies connected between the gimbal ring and the propulsion unit for effecting tilting movement of the propulsion unit relative to the gimbal ring. In other types of marine propulsion devices, such as outboard motors, it is known to have hydraulic cylinder/piston assemblies connected between the mounting bracket and the propulsion unit for effecting steering and/or tilting movement of the propulsion unit relative to the mounting bracket.

In many of these marine propulsion devices having hydraulic assemblies located externally of the boat, means are provided for supplying hydraulic fluid to the hydraulic assemblies from a source of fluid inside the boat. The source of fluid may be connected to an hydraulic circuit also inside the boat that pressurizes and distributes the hydraulic fluid through a manifold interconnecting respective hydraulic lines to the respective hydraulic cylinder assemblies outside the boat. The hydraulic circuit may typically include a pressure pump, and an electric motor coupled to drive the pump. This configuration generally presents several issues. One issue is whether to run the hydraulic lines over the transom or through the transom and, if through the transom, how to seal the opening through which the hydraulic lines pass. Another issue is how to protect the portions of the hydraulic lines extending externally of the transom. For example, the hydraulic lines may be exposed to a relatively harsh external environment, e.g., ocean water, sun rays, and other factors that may promote galvanic corrosion, or other deterioration to the line material. Any deterioration of the lines may be further aggravated due to the bending that the lines may be subject to as the propulsion unit is tilted upwardly and downwardly. This may lead to leaks and a relatively short hydraulic line life. Further, such tilt/drive subsystems may take valuable room in the interior of the boat and require additional holding fixtures and additional labor to install on the boat floor or transom. U.S. Pat. No. 5,032,094 appears to describe a tilt-trim subsystem that uses an intricate external assembly including separate tilt and trim cylinders to provide tilt and trim to an outboard propulsion unit and that may somewhat alleviate some of the above-discussed issues that may develop in outboard units, unfortunately such subsystem does not overcome any of such issues as may be encountered in boats using a stern drive propulsion system since the configuration described in the foregoing patent is strictly limited to outboard designs. Thus, it is desirable to provide a tilt-trim subsystem assembly that, with a lesser number of components, and consequently even more inexpensively and reliably than known assemblies, allows for providing tilt and trim to a stern drive propulsion system that is not subject to the foregoing problems and that can be easily installed either as a replacement kit or as part of an original installation. The increased reliability of the tilt-trim subsystem of the present invention and its ease of service are likely to result in enhanced durability at a lower cost to pleasure boat users and others.

BRIEF SUMMARY OF THE INVENTION

Generally speaking, the present invention fulfills the foregoing needs by providing a stern drive system having an outdrive configured to be rotated about a generally horizontal axis to impart a desired trim or tilt to the drive system. A gimbal unit has means for pivotally receiving a first anchor pin. A tilt-trim subsystem assembly is affixed to the outdrive. The tilt-trim assembly has one respective end thereof configured to pivotally receive a second anchor pin supported by the outdrive. The assembly includes at least one cylinder having one end thereof connected to the first anchor pin so that when the cylinder is actuated the outdrive and the tilt-trim subsystem assembly are rotated about the generally horizontal axis during tilt-trim maneuvers.

The present invention further fulfills the foregoing needs by providing a tilt-trim subsystem assembly affixed to an outdrive of a stern drive that may be supported by a gimbal unit and may be configured to rotate about a predetermined axis to impart a desired trim or tilt to the drive system. The tilt-trim assembly has one respective end thereof configured to pivotally receive one anchor pin supported by the outdrive. The assembly includes one or more cylinders having one end thereof pivotally connected to another anchor pin so that when the cylinder is actuated the outdrive and the tilt-trim subsystem assembly are jointly rotated about the predetermined axis.

BRIEF DESCRIPTION OF THE DRAWINGS

The features and advantages of the present invention will become apparent from the following detailed description of the invention when read with the accompanying drawings in which.

Figure 1:
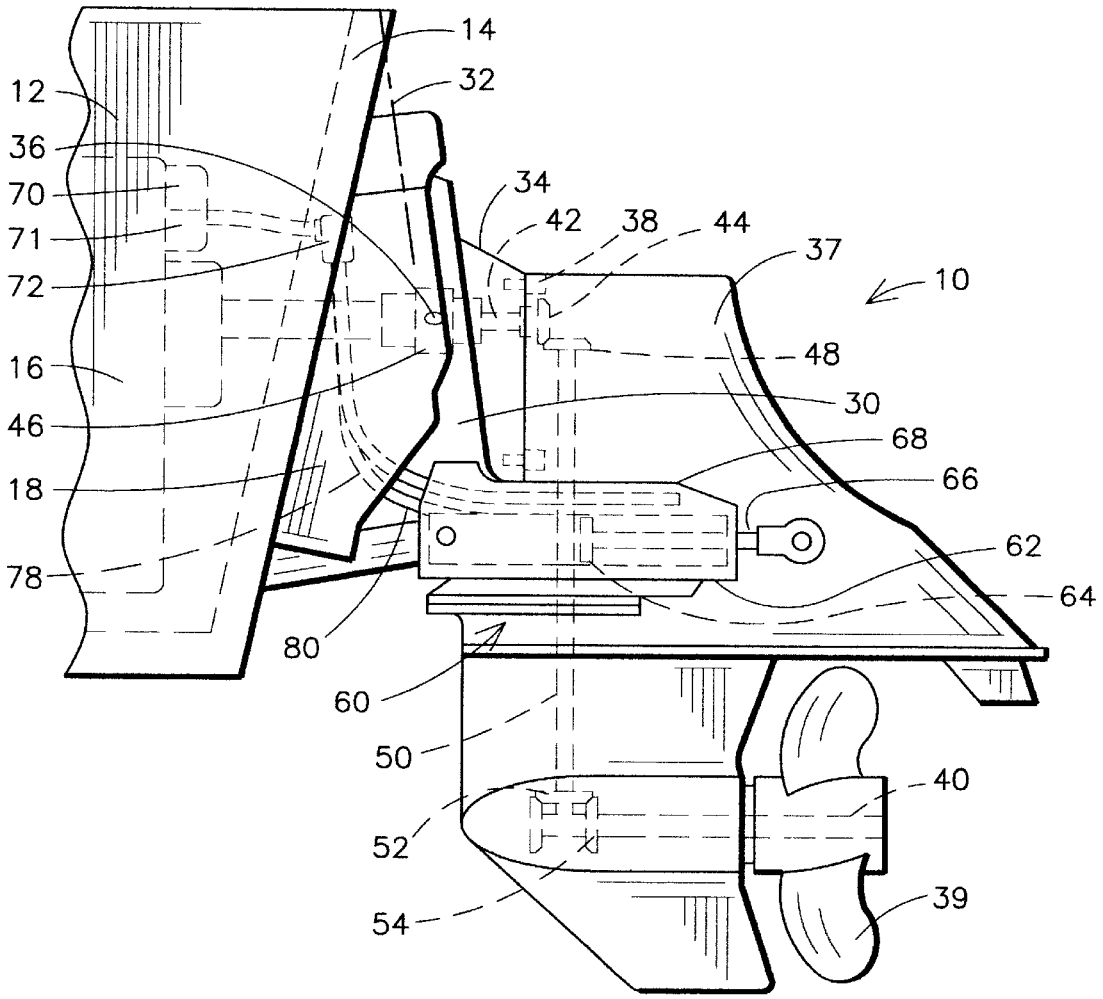
FIG. 1 PRIOR ART
FIG. 1 is a side elevational view of a prior art stern drive system for a boat.

Before any embodiment of the invention is explained in detail it is to be understood that the invention is not limited in its application to the exemplary details of construction and arrangements of components set forth in the following description or illustrated in the drawings. For example, although the cylinder actuating means will be described in the context of hydraulic cylinders, it will be appreciated that in lieu of using hydraulic actuators, electromechanical actuators could be employed to impart the thrust required to tilt or trim the stern drive propulsion system. Thus, the invention is capable of other embodiments and of being practiced or being carried out in various ways. Also, it is to be understood that the phraseology and terminology used herein is for the purpose of illustrative description and should not be regarded as limiting.

DETAILED DESCRIPTION OF THE INVENTION

FIG. 1 illustrates an exemplary prior art marine propulsion device 10 mounted on a boat 12 having a transom 14. The marine propulsion device 10 is of the stern drive or inboard/outboard type. As best shown in FIG. 1, the marine propulsion device 10 comprises an engine 16 securely mounted on the boat frame by suitable means such as rubber mounts (not shown). The marine propulsion device also comprises a mounting bracket or gimbal housing 18 mounted on the outer surface of the boat transom 14 and fixedly attached to the boat transom 14. The gimbal housing 10 can be is attached to the boat transom 14 by any suitable means, such as by bolts extending through the transom 14.

The marine propulsion device 10 also comprises a gimbal unit or gimbal ring 30, connected to the gimbal housing 18 for pivotal movement relative to the gimbal housing 18 about a generally vertical steering axis 32, and a pivot housing 34 connected to the gimbal ring 30 for pivotal movement relative to the gimbal unit 30 about a generally horizontal tilt-trim axis 36. Such a construction is well known in the art and will not be described in detail other than as necessary for an understanding of the invention.

The marine propulsion device 10 also comprises an outdrive 37 that may be removably connected to the pivot housing 34 for common pivotal movement of the outdrive 37 with the pivot housing 34. In the illustrated construction, the outdrive 37 is removably connected to the pivot housing 34 by a plurality of bolts 38. The outdrive 37 includes a propeller 39 mounted on a propeller shaft 40, and a generally horizontal drive shaft 42 having one end removably connected to the engine 16 and an opposite end having thereon a bevel gear 44. A universal joint 46 attached to the horizontal drive shaft 42 allows pivotal movement of the drive shaft 42 with the propulsion unit 37. The bevel gear 44 drives a bevel gear 48 on the upper end of a vertical drive shaft 50. The lower end of the vertical drive shaft 50 has thereon a driving gear 52. A reversible transmission selectively clutches a pair of driven gears 54 to the propeller shaft 40 to transmit forward or reverse motion to the propeller shaft 40 from the driving gear 52.

The marine propulsion device 10 also comprises a pair of hydraulic cylinder/piston assemblies 60 pivotally connected between the gimbal housing 18 and the outdrive 37 for effecting pivotal movement (tilt and trim movement) of the outdrive 37 relative to the gimbal housing 18 and relative to the gimbal unit 30 about the a tilt axis 36. The hydraulic cylinder/piston assemblies 60 are connected between the lower end of the gimbal unit 30 and the outdrive 37. The cylinder/piston assemblies 60 extend on opposite sides of the propulsion unit 37. Each of the cylinder/piston assemblies 60 includes a cylinder 62 having an upper portion, a forward end pivotally connected to the gimbal ring 30, and a rearward end. The cylinder/piston assemblies 60 each also include a piston 64 slidably received in the cylinder 62 for reciprocal movement therein, the piston 64 dividing the cylinder 62 into forward and rearward pressure chambers. The cylinder/piston assemblies 60 also include a piston rod 66 having a forward or inner end fixedly attached to the piston 64 and extending outwardly of the rearward end of the cylinder 62, and a rearward or outer end pivotally attached to the propulsion unit 37. Increasing the pressure in the forward pressure chamber of the cylinder 62 causes the piston rod 66 to extend, thereby causing the propulsion unit 37 to tilt upwardly, and increasing the pressure in the rearward pressure chamber of the cylinder 62 causes the piston rod 66 to retract, thereby causing the propulsion unit 37 to tilt downwardly.

The marine propulsion device 10 further comprises a conduit having one end communicating with a tank 70 inside the boat 12. Tank 70 supplies and stores working hydraulic fluid that may be pressurized by a hydraulic circuit 71 having a motor pump also inside the boat. The conduit has an opposite end communicating with the hydraulic cylinder/piston assemblies 60. The conduit may extend through an opening in the gimbal housing and may be exposed to the environment external to the boat at least between the gimbal housing 18 and the cylinders 60. The conduit further includes a manifold 72, a first fluid line means that allows communication between the manifold 72 and the hydraulic cylinder/piston assemblies 60 for supplying hydraulic fluid to the cylinder/piston assemblies 60, and a second fluid line means extending through the opening in the gimbal housing 18 and having one end communicating with the source of fluid 70, and an opposite end communicating with the manifold 72. The first fluid line means includes a first pair of hydraulic lines communicating between the manifold 72 and the first or right cylinder 62. One of the hydraulic lines of the right pair may be connected to the forward end, e.g., the forward pressure chamber, of the right cylinder 62, and the other hydraulic line of the pair may be connected to the rearward end, e.g., the rearward pressure chamber of the right cylinder 62. The first fluid line means also includes a second pair of hydraulic lines 78 and 80 communicating between the manifold 72 and the second or left cylinder 62. One of the hydraulic lines of the left pair is connected to the forward end, e.g., the forward pressure chamber, of the left cylinder 62, and the other hydraulic line 80 of the left pair being connected to the rearward end, e.g., the rearward pressure chamber, of the left cylinder 62. As will be appreciated by those skilled in the art, although stern drive propulsions systems such as the above-described exemplary prior art system have proven to provide effective propulsion means to boat users, as suggested above and further described below, the present invention allows to even further enhance the reliability and ease of maintenance of such type of marine propulsion systems.

Figure 2:
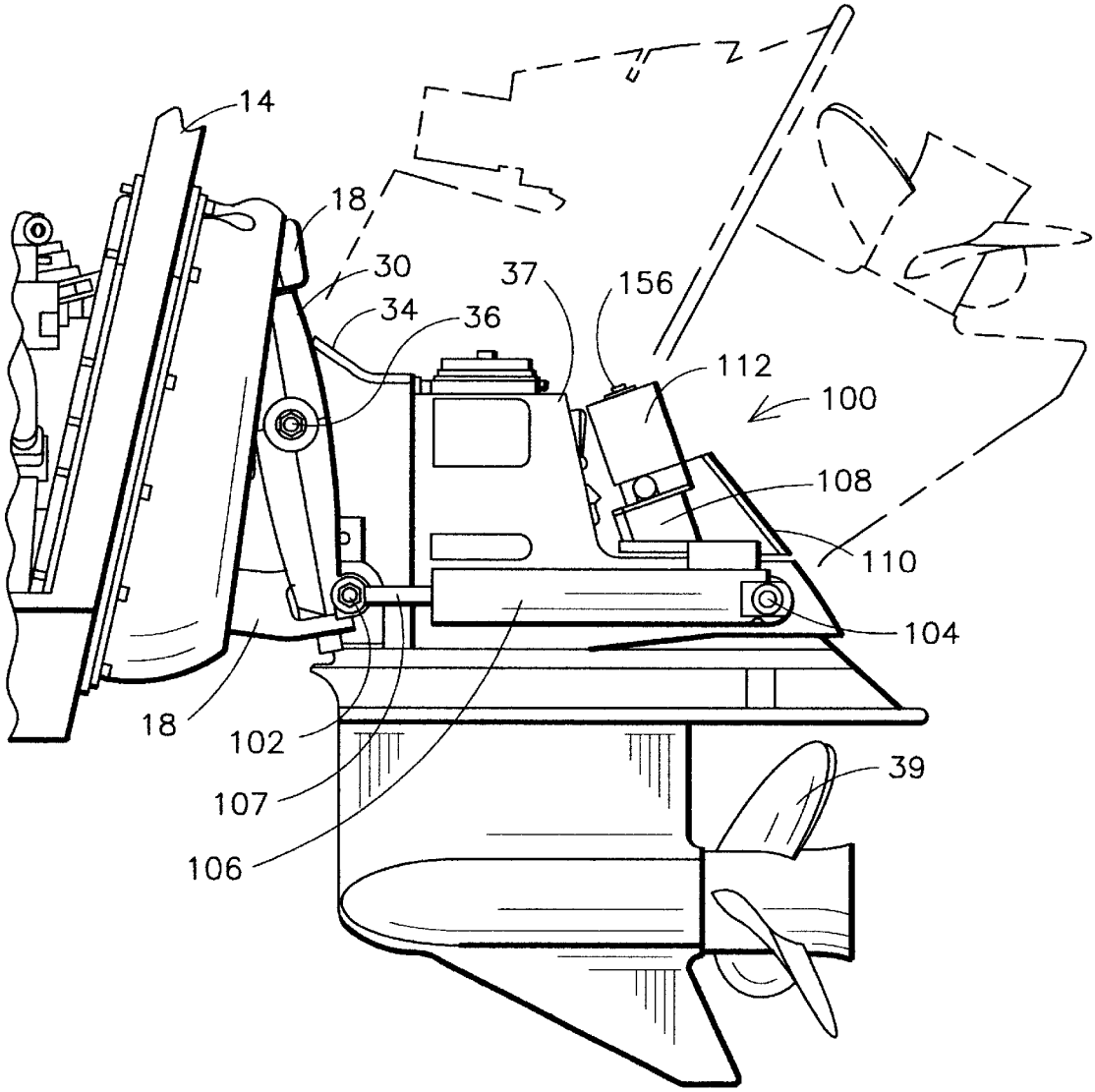
FIG. 2 is a side elevational view of an exemplary embodiment of the present invention showing a tilt-trim subsystem assembly in combination with a stern drive system.
Figure 3:
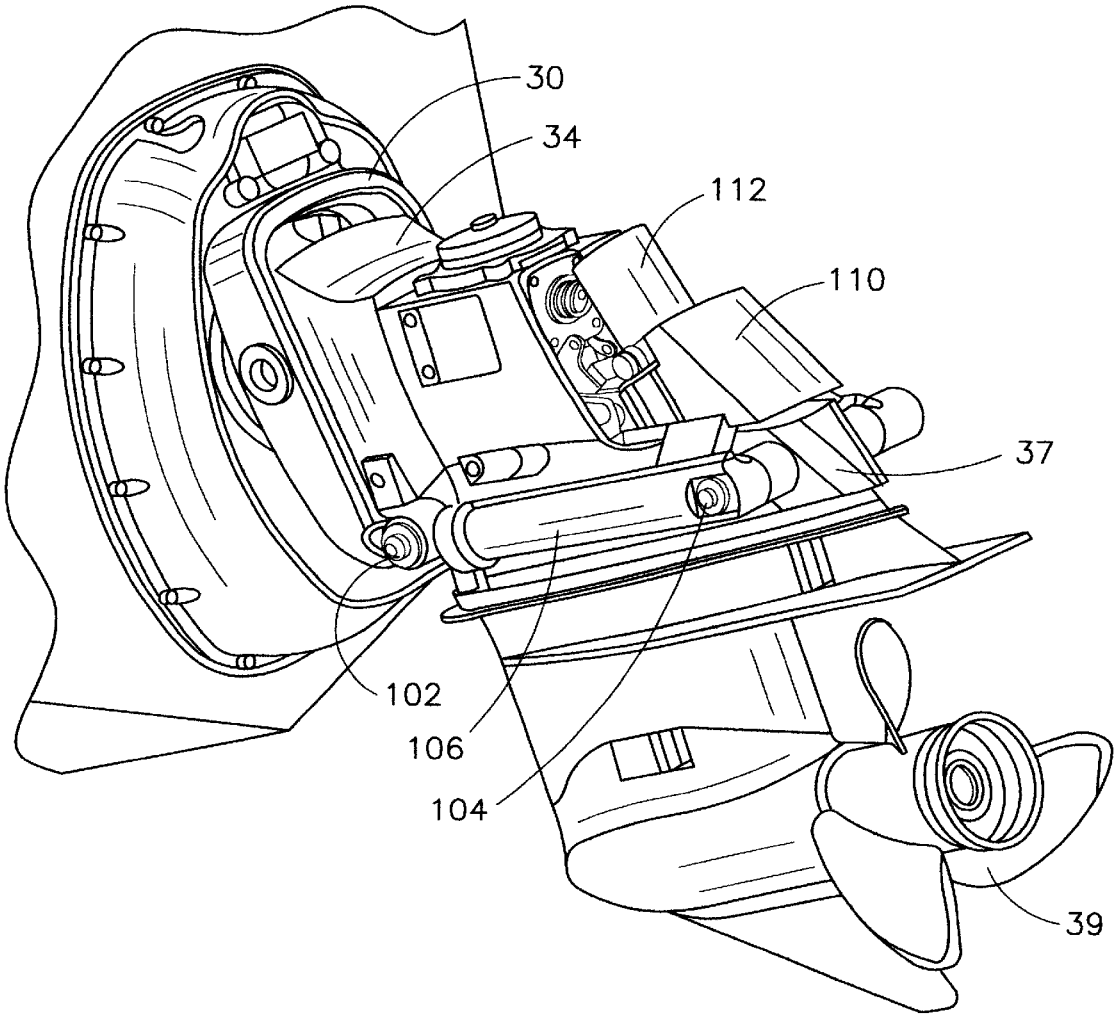
FIG. 3 is an isometric view of the embodiment shown in FIG. 2.
Figure 4:
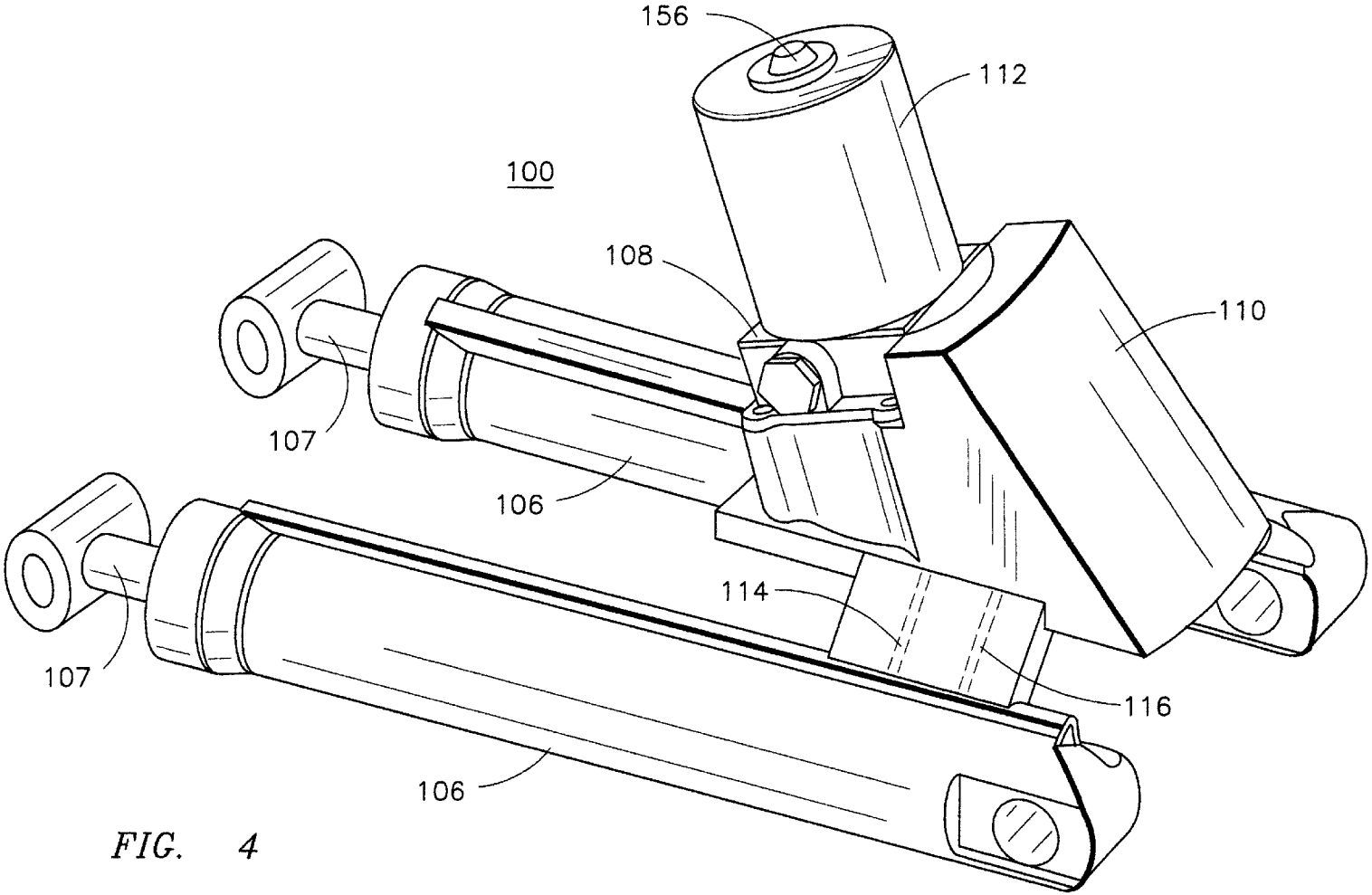
FIG. 4 is an isometric view of the tilt-trim subsystem assembly of the present invention.

FIGS. 2 and 3 illustrate one exemplary embodiment of the present invention showing a tilt-trim subsystem assembly 100 in combination with a stern drive propulsion system. As shown in FIGS. 2 and 3, the tilt/trim subsystem assembly 100 may be affixed to the outdrive 37 using any suitable affixing means, such as pivot pins co-axially disposed relative to tilt-trim axis 36, etc. As further shown in FIGS. 2 and 3, the gimbal unit 30 has means for receiving a first anchor pin 102. As best appreciated in FIG. 4, the tilt/trim subsystem has one end configured to receive a second anchor pin 104 (FIGS. 2 and 3) supported by the outdrive 37. The assembly 100 includes one or more cylinders 106. In the event two cylinders are employed, then one of the cylinders 106 may straddle on one side of outdrive 37, as seen in FIG. 2. The other of the cylinders 106 may straddle on the other side of the outdrive 37, as seen FIG. 4. Each of the cylinders includes a respective slidable piston 107 that may be pivotally connected at one end thereof to the first anchor pin. It will be appreciated that the piston end need not be connected to the first anchor pin since the cylinder/piston could be arranged opposite to the illustrated arrangement so that the piston would be connected to the second anchor pin in lieu of the first anchor pin. As better appreciated in FIG. 4, cylinders 106 and the tilt-trim assembly comprise a unitized body, i.e., they comprise one integral unit that may be constructed using well-known and readily understood casting techniques to those of ordinary skill in the art, e.g., die casting, etc. An exemplary material for the assembly may be aluminum or any other relatively light weight and high strength, and substantially corrosion-resistant material.

Figure 5:
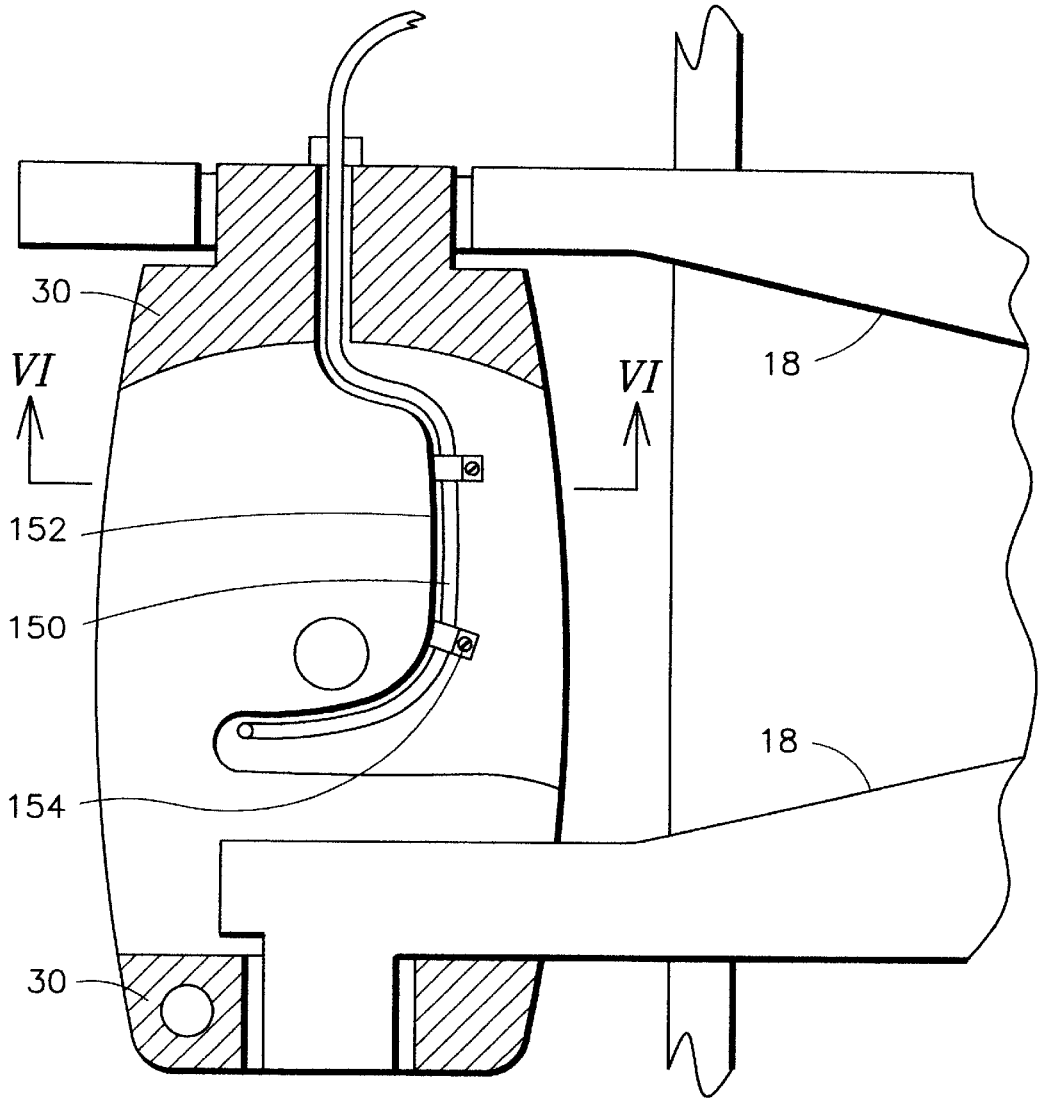
FIG. 5 is a partial cross-section view of an exemplary gimbal unit and gimbal housing configured to have a recess to accommodate leads that may be used for carrying control and power signals to an electric motor in the tilt-trim assembly.
Figure 6:
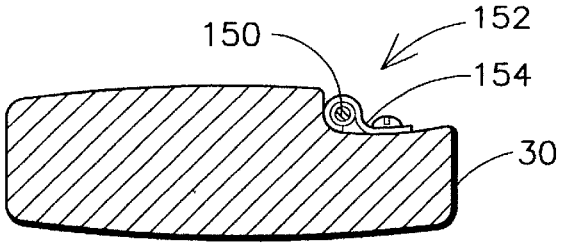
FIG. 6 is cross-section view along line VI–VI in FIG. 5 illustrating further details regarding the recess shown in FIG. 5.

As further shown in FIGS. 2 and 3, assembly 100 contains a fluid circuit, e.g., a hydraulic or pneumatic circuit that is completely self-contained within the assembly for actuating the cylinders 106 and thus avoiding the various issues generally associated with known tilt/trim subsystems for stern drives. In a preferred embodiment, the hydraulic circuit may be chosen due to its good shock absorbing characteristics. As will be appreciated by those skilled in the art, the hydraulic circuit may be configured using design techniques readily understood by those of ordinary skill in the art. For readers interested in background information regarding one exemplary hydraulic design, reference is made to U.S. Pat. No. 4,786,263 commonly assigned to the same assignee of the present invention and herein incorporated by reference. By it way of example, the hydraulic circuit may include a pump 108 and a fluid storage tank 110 connected to pass hydraulic fluid to the pump. The pump 108 may be driven by a motor 112, e.g., a reversible DC motor, in response to externally-derived signals supplied to the motor by way of suitable leads 150 (FIGS. 5 and 6). Both the motor and the pump and any associated hydraulic valves, e.g., relief valves, thermal relief valves, manual release valves, etc., may be disposed in respective compartments within the assembly sufficiently sealed to prevent entry of moisture therewithin.

By way of example and not of limitation, the tilt/trim assembly may include internal passages 114 and 116 (as represented by the dashed lines in FIG. 4) to provide fluid communication between the pump, the cylinders and the tank. For example, one of the passages may provide a path for supplying pressurized fluid to a pressure chamber of a respective cylinder, and the other passage may provide a return path for fluid returning to the pump and/or storage tank. The passages may be bored using standard drilling techniques or may be configured while the assembly is cast using a mold configured to define such internal passages. Alternatively, in lieu of providing internal passages, external tubing could be used to provide the supply and return paths to the fluid flowing into or out of the respective cylinders. It will be appreciated that since the assembly 100 rotates together with the outdrive, then in this embodiment the tubing would not be subject to any bending while the outdrive is being tilted. Similarly, since the length of the tubing is substantially short since the hydraulic circuit and the cylinders are contained substantially proximate to one another, then one could use an inexpensive shield to protect the tubing from the external environment. It will be further appreciated by those skilled in the art, that having shorter hydraulic conduits, either externally or internally located, will is result in improved shock transient response from the hydraulic circuit in the event the propulsion unit were to strike an underwater obstruction or object.

FIGS. 5 and 6 illustrate an exemplary construction that may be provided in the gimbal ring 30 to accommodate one or more leads 150 that may carry the externally-derived signals to the motor 112 in the tilt/trim assembly. As shown in FIGS. 5 and 6, a recess 152, such as a groove or notch, may be configured within the gimbal ring to accommodate leads 150. To secure the leads suitable affixing means, such as clamps 154 may be used to affix the leads 150 within the gimbal ring. The leads need not uninterruptable since one or more connectors could be used at suitable connecting points to facilitate installation and/or servicing of the tilt/trim assembly. By way of example, a connector or plug 156 could be installed onto the trim/tilt assembly, e.g. near the motor compartment, so as to provide a suitable interconnecting point between any leads disposed within that motor compartment and leads 150. It will be appreciated that any commercially available water-tight connector designed for a marine environment operation will provide a suitable seal so as to prevent entry of moisture into the tilt-trim assembly.

Thus, it should now be appreciated that with the present invention, as described above, since the cylinder or cylinders in the tilt/trim assembly comprise a unitized structure and are angularly movable in unison relatively to the gimbal housing, and further since the working hydraulic fluid conduits interconnecting the motor pump, and the tilt/trim cylinder or cylinders therein may now be defined, if so desired, without employing exteriorly installed tubing, then the present invention allows for either avoiding altogether, in the case of internal passageways, or substantially avoiding, in the case of short external tubing, the problem of fluid conduit corrosion, etc. Further, the tilt-trim subsystem may be constructed as a single assembly with the hydraulic pressure circuit incorporated in the assembly. Thus, the tilt-trim subsystem can easily be attached to and detached as a kit from the outdrive and the gimbal housing. As suggested above, the assembly of the present invention because of its integrated construction and improved transient response characteristics may provide increased protection against shocks that may be produced when the propulsion unit is hit by objects, such as driftwood, etc.

While the preferred embodiments of the present invention have been shown and described herein, it will be obvious that such embodiments are provided by way of example only. For example, although some aspects of the present invention have been described in the context of an hydraulic circuit, it will be appreciated that in lieu of using hydraulic cylinders, torque-applying screws rotated by a respective electromechanical actuator could be employed to impart the torque required to tilt or trim the stern drive propulsion system, Thus, numerous variations, changes and substitutions will occur to those of skill in the art without departing from the invention herein. Accordingly, it is intended that the invention be limited only by the spirit and scope of the appended claims.

What is claimed is:

1. A stern drive system having an outdrive generally disposed downstream relative to water flow aft a transom of a boat, the outdrive configured to be rotated about a generally horizontal axis to impart a desired trim or tilt to the drive system comprising:

a gimbal unit having means for pivotally receiving a first anchor pin;

a tilt-trim subsystem assembly affixed to the outdrive, the tilt-trim assembly having one respective end thereof configured to pivotally receive a second anchor pin supported by the outdrive, the assembly including at least one cylinder having one end thereof connected to the first anchor pin so that when the cylinder is actuated the outdrive and the tilt-trim subsystem assembly are rotated about the generally horizontal axis, the assembly further including a circuit coupled to actuate the at least one cylinder therein, said circuit positioned within the footprint of the outdrive to avoid wherein the circuit includes at least a pump and a motor.

2. The drive system of claim 1 wherein the at least one cylinder and the circuit comprise a unitized body.

3. The drive system of claim 2 wherein the utilized body is an integral body.

4. The drive system of claim 2 wherein the at least one cylinder and the circuit comprise respective bodies affixed to one another as a single assembly.

5. The drive system of claim 1 wherein the circuit is selected from the group consistent of hydraulic, pneumatic or electromechanical circuits.

6. The drive system of claim 1 wherein the circuit comprises a hydraulic circuit including a pump and a fluid storage tank connected to pass a predetermined fluid to the pump.

7. The drive system of claim 6 wherein the tilt-trim assembly includes passages within the assembly and configured to provide fluid communication between the pump, the at least one cylinder and the tank.

8. The drive system of claim 6 wherein the tilt-trim assembly includes tubing configured to provide fluid communication between the pump, the at least one cylinder and the tank.

9. The drive system of claim 6 wherein the tubing is externally located relative to the assembly.

10. The drive system of claim 6 wherein the hydraulic circuit further comprises an electric motor coupled to drive the pump in response to externally-derived signals supplied to the motor.

11. The drive system of claim 10 wherein the gimbal unit includes a recess for receiving a plurality of leads coupled to the electric motor for supplying the externally-derived signals to the motor.

12. The drive system of claim 11 wherein the recess is sealed to prevent entry of moisture into the motor.

13. The drive system of claim 1 wherein the respective end of at the at least one cylinder comprises a piston connected to the first anchor pin to impart rotation in a first direction upon the piston being extended and in a second direction opposite the first direction upon the piston being retracted.

14. A boat having a stern drive propulsion system including an outdrive generally disposed downstream relative to water flow aft a transom of the boat, the outdrive configured to be rotated about a predetermined axis to impart a desired trim or tilt to the drive system, the boat comprising:

a gimbal unit having means for pivotally receiving a first anchor pin pair;

a gimbal unit having means for pivotally receiving a first anchor pin pair;

a tilt-trim subsystem assembly affixed to the outdrive, the tilt-trim assembly having one respective end thereof configured to pivotally receive a second anchor pin pair supported by the outdrive, the assembly including a pair of cylinders, each cylinder straddling a respective side of the outdrive and having one end thereof connected to the corresponding first anchor pin so that when the cylinder pair is actuated the outdrive and the tilt-trim subsystem assembly are rotated together about the predetermined axis, the assembly further including a hydraulic circuit configured to actuate the cylinder pair therein, the hydraulic circuit configured to actuate storage tank connected to pass a predetermined fluid to the pump, said pump and tank being interposed within the cylinder pair and positioned rearwardly of the outdrive to avoid resistance to water flow.

15. The boat of claim 14 wherein the cylinder pair and the circuit comprises a unitized body.

16. The boat of claim 15 wherein the unitized body is an integral body.

17. The boat of claim 15 wherein the cylinder pair and the circuit comprise respective bodies affixed to one another as a single assembly.

18. The boat of claim 14 wherein the tilt-trim assembly includes passages within the assembly configured to provide fluid communication between the pump, the cylinder pair and the tank.

19. The boat of claim 14 wherein the tilt-trim assembly includes tubing configured to provide fluid communication between the pump, the cylinder pair and the tank.

20. The boat of claim 19 wherein the tubing is externally located relative to the assembly.

21. The boat of claim 14 wherein the hydraulic circuit further comprises an electric motor coupled to drive the pump in response to externally-derived signals supplied to the motor.

22. The boat of claim 21 wherein the gimbal unit includes a recess for receiving a plurality of leads coupled to the electric motor for supplying the externally-derived signals to the motor.

23. The boat of claim 22 wherein the recess is sealed to prevent entry of moisture into the motor.

24. The boat of claim 14 wherein each respective end of the cylinder pair comprises a piston connected to the corresponding first anchor pin to impart rotation in a first direction upon each piston being extended and in a second direction opposite the first direction upon each piston being retracted.

25. A tilt-trim subsystem assembly affixed to an outdrive of a stern drive supported by a gimbal unit and configured to rotate about a predetermined axis to impart a desired trim or tilt to the drive system, the tilt-trim assembly having one respective end thereof configured to pivotally receive one anchor pin supported by the outdrive, the assembly including at least one cylinder having one end thereof pivotally connected to another anchor pin so that when the cylinder is actuated the outdrive and the tilt-trim subsystem assembly are jointly rotated about the predetermined axis, the assembly further including a hydraulic circuit for actuating the at least one cylinder therein, the hydraulic circuit comprising a pump and an electric motor coupled to drive the pump in response to externally-derived signals, the gimbal unit including a recess for receiving a plurality of leads coupled to the electric motor for supplying the externally-derived signals to the motor and wherein the recess is sealed to prevent entry of moisture into the motor.

26. The assembly of claim 25 wherein the at least one cylinder and the circuit comprise a unitized body.

27. The assembly of claim 26 wherein the unitized body is an integral body.

28. The assembly of claim 26 the at least one cylinder and the circuit comprise respective bodies affixed to one another as a single assembly.

29. The assembly of claim 25 wherein the hydraulic circuit further comprises a fluid storage tank connected to pass a predetermined fluid to the pump.

30. The assembly of claim 29 further including passages within the assembly and configured to provide fluid communication between the pump, the at least one cylinder and the tank.

31. The assembly of claim 29 further including tubing configured to provide fluid communication between the pump, the at least one cylinder and the tank.

32. The assembly of claim 31 wherein the tubing is externally located relative to the assembly.

33. The assembly of claim 25 wherein the respective end of the at least one cylinder comprises a piston connected to the first anchor pin to impart rotation in a first direction upon the piston being extended and in a second direction opposite the first direction upon the piston being retracted.

34. A kit affixed to an outdrive of a stern drive supported by a gimbal unit and configured to rotate together with the outdrive to impart a desired trim or tilt to the drive system, the kit comprising:

a tilt-trim assembly having one respective end thereof configured to receive one anchor pin supported by the outdrive section, the assembly including at least one cylinder having one end thereof connected to another anchor pin so that when the cylinder is actuated the outdrive and the tilt-trim subsystem assembly are jointly rotated about a predetermined axis, the assembly further including a hydraulic circuit for actuating the at least one cylinder therein, the hydraulic circuit comprising a pump and a fluid storage tank connected to pass a predetermined fluid to the pump, the hydraulic circuit further comprising an electric motor coupled to drive the pump in response to externally-derived signals supplied to the motor and wherein the respective end of the at least one cylinder comprises a piston connected to the first anchor pin to impart rotation in a first direction upon the piston being extended and in a second direction opposite the first direction upon the piston being retracted, the assembly including passages within the assembly situated proximate the first anchor loin to provide fluid communication between the pump and the at least one cylinder therein.

35. The kit of claim 34 wherein the at least one cylinder and the circuit comprise a unitized body.

36. The kit of claim 35 wherein the unitized body is an integral body.

37. The kit of claim 35 wherein the at least one cylinder and the circuit comprise respective bodies affixed to one another as a single assembly.

38. The kit of claim 34 further including passages within the assembly configured to provide fluid communication between the pump, the at least one cylinder and the tank.

39. The kit of claim 34 further including tubing configured to provide fluid communication between the pump, the at least one cylinder and the tank.

40. The kit of claim 39 wherein the tubing is externally located relative to the assembly.

41. A method of assembling a tilt-trim subsystem for use in a stern drive system having an outdrive generally disposed downstream relative to water flow aft of the boat transom, the outdrive configured to be rotated about a generally horizontal axis to impart a desired trim or tilt to the drive system, the method comprising:

receiving a first anchor pin to be pivotally supported by a respective gimbal unit; affixing the tilt-trim subsystem assembly to the outdrive section;

receiving a second anchor pin at one respective end of the tilt-trim assembly to be pivotally supported by the outdrive, the assembly including at least one cylinder having one end thereof connected to the first anchor pin so that when the cylinder is activated the outdrive and the tilt-trim subsystem assembly may be rotated together about the generally horizontal axis;

disposing in the tilt-trim assembly a hydraulic circuit for actuating the at least one cylinder therein;

defining at least one or more respective compartments for the hydraulic circuit respectively receiving a pump and defining a fluid storage tank connected to pass a predetermined fluid to the pump; and defining a compartment in the assembly for receiving an electric motor coupled to drive the pump and wherein each of said compartments is positioned within the footprint of the outdrive to avoid resistance to water flow.

42. The method of claim 41 wherein the at least one cylinder and the circuit comprise a unitized body.

43. The method of claim 42 wherein the unitized body is an integral body.

44. The method of claim 42 wherein the at least one cylinder and the circuit comprise respective bodies affixed to one another as a single assembly.

45. The method of claim 41 further comprising a step of defining passages within the assembly, the passages being configured to provide fluid communication between the pump, the at least one cylinder and the tank.

46. The method of claim 41 comprising a step of providing tubing configured to provide fluid communication between the pump, the at least one cylinder and the tank.

47. The method of claim 46 wherein the tubing is externally located relative to the assembly.

48. The method of claim 41 further comprising a step of defining passages within the assembly in the gimbal unit for receiving a plurality of leads coupledto the electric motor for supplying control signals and electric power to the motor.

49. The method of claim 48 wherein the recess is sealed to prevent entry of moisture into the motor.

50. The method of claim 41 wherein the respective end of the at least one cylinder comprises a piston connected to the first anchor pin to impart rotation in a first direction upon the piston being extended and in a second direction opposite the first direction upon the piston being retracted.

51. A tilt-trim system for a stern drive having an outdrive, the tilt-trim system comprising an actuactor including a cylinder/piston unit and a unitized body, the unitized body being integrally cast and having a bore formed therein within which the actuator extends and retracts to rotate the outdrive about a generally horizontal axis and thereby impart a desire trim or tilt to the stern drive, the tilt-trim system further including a fluid circuit for actuating the actuator, the fluid circuit being routed through passages formed within the unitized body the unitized body being configured to be within the footprint of the outdrive and positioned generally rearwardly of and wherein the pump and electric motor are positioned on the stern drive outdrive.

52. A stern drive system having an outdrive configured to be rotated about a generally horizontal axis to impart a desired trim or tilt to the drive system comprising:

a gimbal unit having means for pivotally receiving a first anchor pin;

a tilt-trim subsystem assembly affixed to the outdrive, the tilt-trim assembly having one respective end thereof configured to pivotally receive a second anchor pin supported by the outdrive, the assembly including at least one cylinder having one end thereof connected to the first anchor pin so that when the cylinder is actuated the outdrive and the tilt-trim subsystem assembly are rotated about the generally horizontal axis, the assembly further including a hydraulic circuit for actuating the at least one cylinder therein, the hydraulic circuit comprising a pump and a fluid storage tank connected to pass a predetermined fluid to the pump, the hydraulic circuit further comprising an electric motor coupled to drive the pump in response to externally-derived signals, the gimbal unit including a recess for receiving a plurality of leads coupled to the electric motor for supplying the externally-derived signals to the motor and wherein the recess is sealed to prevent entry of moisture into the motor.

53. The drive system of claim 52 wherein the at least one cylinder and the circuit comprise a unitized body.

54. The drive system of claim 53 wherein the unitized body is an integral body.

55. The drive system of claim 53 where the at least one cylinder and the circuit comprise repsective bodies affixed to one another as a single assembly.

56. The drive system of claim 52 wherein the tilt-trim assembly includes passages within the assembly configured to provide fluid communication between the pump, the at least one cylinder and the tank.

57. The drive system of claim 52 wherein the tilt-trim assembly includes tubing configured to provide fluid communication between the pump, the at least one cylinder and the tank and wherein the tubing is externally located relative to the assembly.

58. The drive system of claim 52 wherein the respective end of at the at least one cylinder comprises a piston connected to the first anchor pin to impart rotation in a first direction upon the piston being extended and in a second direction opposite the first direction upon the piston being retracted.

59. A method of assembling a tilt-trim subsystem for use in a stern drive system generally disposed aft of the boat transom and having an outdrive configured to be rotated about a generally horizontal axis to impart a desired trim or tilt to the drive system, the method comprising:

receiving a first anchor pin to be pivotally supported by a respective gimbal unit;

affixing the tilt-trim subsystem assembly to the outdrive section;

receiving a second anchor pin at one respective end of the tilt-trim assembly to be pivotally supported by the outdrive, the assembly including at least one cylinder having one end thereof connected to the first anchor pin so that when the cylinder is activated the outdrive and the tilt-trim subsystem assembly may be rotated together about the generally horizontal axis;

disposing in the tilt-trim assembly a hydraulic circuit for actuating the at least one cylinder therein;

defining a compartment in the assembly for receiving a pump;

defining a compartment in the assembly for receiving an electric motor coupled to drive the pump; and defining a recess in the gimbal unit for receiving a plurality of leads coupled to the electric motor for supplying control signals and electric power to the motor and wherein the recess is sealed to prevent entry of moisture into the motor.

60. The method of claim 59 wherein the at least one cylinder and the circuit comprise a unitized body and wherein the unitized body is an integrally cast body.

61. The method of claim 59 wherein the at least one cylinder and the tilt-trim assembly comprise respective bodies affixed to one another as a single assembly.

62. The method of claim 59 further comprises a step of defining a compartment for receiving a fluid storage tank connected to pass a predetermined fluid to the pump.

63. The method of claim 62 further comprising a step of defining passages within the assembly, the passages being configured to provide fluid communication between the pump, the at least one cylinder and the tank.

64. The method of claim 62 comprising a step of providing tubing configured to provide fluid communication between the pump, the at least one cylinder and the tank.

* * * * *

UNITED STATES PATENT AND TRADEMARK OFFICE

CERTIFICATE OF CORRECTION

PATENT NO. : 6,296,535 B1
DATED : October 2, 2001
INVENTOR(S) : Bland, G. et al

It is certified that error appears in the above-identified patent and that said Letters Patent is hereby corrected as shown below:

Title page,
ABSTRACT, delete the word "a" from the second to last line;

Column 1,
Line 13, delete the word "a" before "mounting";
Line 14, delete "aid" before "stern drive";

Column 3,
Line 13, insert "10" after "marine propulsion device";
Line 17, delete "is" before "attached";

Column 5,
Line 22, delete "it" before "way";
Line 57, delete "is" before "result";

Column 6, claim 1,
Line 64, after the word "avoid", insert -- resistance to water flow --;

Column 7, claim 14,
Lines 46-47, delete the second occurrence of "a gimbal unit having means for pivotally receiving a first anchor pin pair";

Column 7, claim 14,
Line 59, delete the second occurrence of "configured to actuate" and substitute therefor -- comprising a pump and a fluid --;

Column 7, claim 15,
Line 65, delete "comprises" and substitute therefor -- comprise --;

Column 9, claim 34,
Line 28, delete "loin" and substitute therefor -- pin --;

Column 9, claim 34,
Line 29, insert "and wherein the pump and electric motor are positioned on the stern drive outdrive" before "." at the end of the claim;

UNITED STATES PATENT AND TRADEMARK OFFICE

CERTIFICATE OF CORRECTION

PATENT NO. : 6,296,535 B1
DATED : October 2, 2001
INVENTOR(S) : Bland, G. et al

It is certified that error appears in the above-identified patent and that said Letters Patent is hereby corrected as shown below:

Column 10, claim 48,
Line 23, delete "passages within the assembly" and substitute therefor -- a recess --;
Line 24, delete "coupledto" and substitute therefor -- coupled to --;

Column 10, claim 51,
Line 42, delete "," after the first occurrence of "body";
Line 44, delete "and wherein the pump and electric motor are positioned on the stern drive outdrive" and substitute therefor -- said outdrive and further comprising a pump and motor situated on the outdrive --.

Signed and Sealed this

Sixteenth Day of April, 2002

*Attest:*

*Attesting Officer*

JAMES E. ROGAN
*Director of the United States Patent and Trademark Office*